US009061172B1

(12) United States Patent
Carrier

(10) Patent No.: US 9,061,172 B1
(45) Date of Patent: Jun. 23, 2015

(54) EXERCISE APPARATUS USING A SINGLE ELASTIC MEMBER

(71) Applicant: Mark N. Carrier, Chesapeake, VA (US)

(72) Inventor: Mark N. Carrier, Chesapeake, VA (US)

( * ) Notice: Subject to any disclaimer, the term of this patent is extended or adjusted under 35 U.S.C. 154(b) by 71 days.

(21) Appl. No.: 14/085,002

(22) Filed: Nov. 20, 2013

(51) Int. Cl.
*A63B 23/04* (2006.01)
*A63B 21/00* (2006.01)

(52) U.S. Cl.
CPC ..... *A63B 23/0458* (2013.01); *A63B 21/00047* (2013.01)

(58) Field of Classification Search
USPC ..... 482/51–53, 121–129, 142
See application file for complete search history.

(56) References Cited

U.S. PATENT DOCUMENTS

| | | | | |
|---|---|---|---|---|
| 4,092,075 | A * | 5/1978 | Kimball | 403/72 |
| 4,869,520 | A * | 9/1989 | Cole | 280/164.1 |
| 5,076,544 | A * | 12/1991 | Mueller | 254/332 |
| 5,352,176 | A | 10/1994 | Huang | |
| 5,454,611 | A * | 10/1995 | Wanat | 294/24 |
| 5,494,388 | A * | 2/1996 | Stevens | 410/112 |
| 6,063,007 | A * | 5/2000 | Sithole | 482/52 |
| 6,076,448 | A * | 6/2000 | Rexroad | 87/12 |
| 6,247,328 | B1 * | 6/2001 | Mogil | 62/457.2 |
| 6,280,366 | B1 | 8/2001 | Hsich | |
| 6,431,947 | B1 * | 8/2002 | Henz | 450/86 |
| 6,740,008 | B1 | 5/2004 | Ho et al. | |
| 6,908,418 | B2 | 6/2005 | Saure | |
| 6,981,934 | B1 | 1/2006 | Shifferaw | |
| 7,393,272 | B2 * | 7/2008 | Sundet | 454/275 |
| 7,410,450 | B1 * | 8/2008 | Paulding | 482/121 |
| 7,608,025 | B1 | 10/2009 | Best | |
| 7,739,775 | B2 * | 6/2010 | Shimanski | 24/265 H |
| 7,762,937 | B2 | 7/2010 | Younane et al. | |
| 7,931,575 | B2 | 4/2011 | Rochford | |
| 7,987,563 | B2 * | 8/2011 | Goeson | 24/302 |
| 2005/0020418 | A1 | 1/2005 | Lin | |
| 2005/0049123 | A1 | 3/2005 | Dalebout | |
| 2006/0040808 | A1 | 2/2006 | Riazi | |
| 2007/0087920 | A1 | 4/2007 | Dachraoui | |
| 2010/0130338 | A1 | 5/2010 | Wehrell | |

* cited by examiner

*Primary Examiner* — Stephen Crow
(74) *Attorney, Agent, or Firm* — William G. Sykes

(57) ABSTRACT

A step exercise apparatus having a rectangular step structure having a flat upper surface, a pair of end walls, a pair of side walls, a perimeter, and an inset ledge having an upward facing surface circumferentially disposed around the flat upper surface. A series of hooks each having an upward-facing hook opening is disposed around the perimeter adjacent the upward facing surface of the ledge. In addition, a series of hooks each having a downward-facing hook opening is disposed around the perimeter adjacent the bottom edge. The hooks having an upward-facing hook opening are interspersed with the said hooks having a downward-facing hook opening. An elastic member may be threaded through adjacent hooks with upper and lower hooks forming a serpentine path. Ends of the elastic member may be equipped with handles and may be directed upwardly from any of the lower hooks.

12 Claims, 12 Drawing Sheets

EXERCISE APPARATUS USING A SINGLE ELASTIC MEMBER

FIELD OF THE INVENTION

The invention pertains to exercise and, more particularly, to an exercise apparatus using a single, readily reconfigurable elastic band.

BACKGROUND OF THE INVENTION

It is estimated that 77 million people were born between 1946 and 1964. This group of people now constitutes the largest population component both in terms of size and percentage of the population of the United States. Similar statistics apply to other countries and regions of the world. By 2015, people aged 50 and older will represent approximately 45% of the population of the United States. This population often referred to as "baby boomers" seem, in large part, to be serious about their overall health and particularly about their physical fitness.

When surveyed, nearly half of these people, when given a choice, would prefer to exercise alone. While individuals typically at least intellectually understand the importance of exercise, the number of overweight or other physically out of shape individuals, particularly in the United States, continues to grow at an alarming rate. One factor that confronts individuals wishing to exercise in a gym or other exercise establishment outside their home is simply finding and blocking out the time to go there. Another factor, especially for those who travel, is the inconvenience of "working out" when away from home.

Presently, a large variety of exercise equipment is available. This equipment ranges from simple step devices, exercise mats, and free weights, to large and complex machinery that may be computer controlled. Such devices typically include treadmills, rowing and stepping machines, and many other types of exercise devices. Many individuals are limited in the number and type of exercise devices they may own, generally as a result of the cost of such equipment and the space necessary to store and use the equipment. Even gyms and other exercise establishments must be conscious of the space required by each piece of equipment. Consequently, the number of pieces of exercise equipment which the gym may provide to its users may be unduly limited.

Those who exercise regularly typically follow an exercise regimen wherein they work out at home or at a gym one or more times per week. These individuals generally find it desirable to maintain their regimen when traveling, such as when on a business trip or vacation. Further, some individuals prefer not to work out in a gym at all. Rather, they prefer to work out at home or work. For these reasons, it is desirable to provide exercise equipment that is portable, is easy to store, and readily transportable, for example in the overhead compartment of an aircraft.

In addition to the foregoing, many individuals typically engage in multiple, varied exercises. For example, some individuals perform step exercises that involve stepping on and off a raised platform. Such exercises are known for their cardiovascular benefits and work-out of an individual's legs. In addition, the same individuals may wish to engage in strength and flexibility training involving other portions of the body, such as the arms, chest and shoulders. Such exercises have traditionally included bicep curls, rowing, overhead presses and the like, each targeted to strengthen various specific areas of the body.

Presently available exercise equipment is deficient in addressing all the exercise needs of a particular individual. For example, large multi-station weight machines may provide a user with the opportunity to perform a large number of exercises. However, such machines are typically large and expensive and not readily transportable. Simple step devices are available (including some that may be raised and lowered). These devices while being easy to transport and relatively inexpensive, they typically afford the user a limited variety of exercises.

Consequently, there is a need for an exercise apparatus that is affordable, conveniently stored, readily transportable, easy to use and that provides a user a wide variety of possible exercises.

DISCUSSION OF THE RELATED ART

Several attempts may be found in the prior art that attempt to overcome one or more of the shortcomings discussed hereinabove. For example, Published United States Patent Application No. 2005/0020418 for DEVICE FOR AEROBIC EXERCISE, published Jan. 27, 2005 upon application by William Lin teaches a device for aerobic exercise, a resilient bladder body having a bottom wall disposed on a base frame, a curved surrounding wall connected to the bottom wall so as to define a fluid-receiving space therebetween, and a surrounding flange extending downwardly from the curved surrounding wall and disposed to surround the base frame. The bladder body defines a first axis that passes through a center of the bottom wall and along which the bottom wall has a width, and a second axis which passes through the center of the bottom wall and a top wall portion of the surrounding wall, which is transverse to the first axis and along which the curved surrounding wall has a maximum height less than the width of the bottom wall. The top wall portion has rigidity greater than that of the surrounding wall portion and less than that of the bottom wall.

Published United States Patent Application No. 2005/0049123 for EXERCISE DEVICE WITH ELONGATED FLEXIBLE MEMBER published Mar. 3, 2005 upon application by William T Dalebout et al. Dalebout et al. show an exercise device that enhances a body workout by requiring a user to maintain balance while exercising. The exercise device has an elongate flexible member connected to a base. The flexible member has an upper surface and a lower surface. The upper surface has a pair of foot placement portions configured and arranged such that a user positioned thereon must exercise balance. The foot placement portions are separated along the longitudinal axis such that a user standing thereon assumes an athletic stance.

Published United States Patent Application No. 2006/0040808 for EXERCISE APPARATUS published Feb. 23, 2006 upon application by John Riazi that teaches a base configured to stabilize rolling movement of the exercise ball under the influence of a user seated on the ball. The base defines a range in which rolling movement of the ball is unimpeded by the base, and has an obstacle portion configured to impede rolling movement of the ball beyond that range. This enables the base to stabilize the ball and the seated user upon rolling movement of the ball into contact with the obstacle portion of the base.

Published United States Patent Application No. 2007/0087920 for PORTABLE EXERCISE DEVICE published Apr. 19, 2007 upon application by Moncef Dachraoui et al. Dachraoui et al. disclose a portable exercise device, a method of making the device, and a method of exercising using the device. The device has a generally rectangular, box-like main body in two portions, hinged together for opening and closing and having a storage area within. Recessed areas operable for attaching suitably equipped resistance tubing are disposed in an array that enables a variety of exercises.

U.S. Pat. No. 7,410,450 for PORTABLE ELASTIC RESISTANCE EXERCISE APPARATUS issued Aug. 12, 2008 to Kenneth F. Paulding. Paulding teaches a portable elastic resistance exercise apparatus comprising two panels selectively affixed in a 90 degree angle. Both panels are padded for user interaction. Elastic resistance is positioned as chosen within cutouts in the back panel, at any height and with any resistance chosen. Grips on the resistance enable either grasping or hooking around limbs or body parts. The apparatus folds for portability and also includes non-skid and other anchoring devices for temporary affixation to foreign objects and surfaces. The apparatus therefore offers a truly portable, all-in-one exercise device.

U.S. Pat. No. 7,931,575 for APPARATUS FOR PERFORMING BODY EXERCISES issued Apr. 26, 2011 to Timothy Shawn Rochford teaches a method of using a self-contained portable exercise apparatus for performing upper and/or lower body exercises. The method includes performing a body exercise without weights using an elastic cord, a stability ball, and/or a stretch cord with an apparatus having a ground-engaging base plate which rigidly supports first and second vertical members, where each vertical member has aligned clearance openings. Holding members are attached to the base plate for removably holding stretch cords and a support bar is removably received by two aligned clearance openings in the first and second vertical members.

None of the patents or any of the published patent applications, taken singly, or in any combination are seen to teach or suggest the novel Exercise Apparatus Using a Single Elastic Member of the present invention.

SUMMARY OF THE INVENTION

In accordance with the present invention there is provided a step exercise apparatus having a rectangular step structure having a width, a length, a height, a flat upper surface, a pair of opposing upstanding end walls, a pair of opposing upstanding side walls disposed orthogonally to the pair of upstanding end walls, a perimeter with a ledge having an upward facing surface parallel the upward facing top surface circumferentially disposed therearound intermediate the upward facing top surface and an upper edge of each of the upstanding side walls and the upstanding end walls, the upward facing surface of the ledge being at a level lower than said upward facing top surface. A series of hooks each having an upward-facing hook opening disposed around said perimeter of the rectangular step adjacent the upward facing surface of the ledge. In addition, a series of hooks each having a downward-facing hook opening is disposed around said perimeter adjacent the bottom edge of the step edge of said pair of opposing end walls, and said pair of opposing side walls, the hooks having an upward-facing hook opening being interspersed between the hooks having a downward-facing hook opening. An elastic member may be threaded through adjacent hooks with upper and lower hooks forming a serpentine path. Ends of the elastic member may be equipped with handles and may be directed upwardly from any of the lower hooks. Each exercise to be performed may require a different configuration of the elastic member. Further, elastic members of a variety of lengths may be used. Because there is no fastening of the elastic member to the step, setup and modification are extremely quick. A wide variety of exercises may be performed by selecting an appropriate length elastic member, properly positioning it on the step, and position the user's body in a manner relative to the step (e.g., standing, squatting, one foot off the step. With the novel exercise apparatus, an exercise regime may be established and the exercise apparatus reconfigured very quickly between exercises.

It is, therefore, an object of the invention to provide an exercise device utilizing a rectangular base and a single elastic cord.

It is another object of the invention to provide an exercise device utilizing a rectangular base having a number of elastic cord-retaining hooks disposed around a lower perimeter thereof.

It is an additional object of the invention to provide an exercise device utilizing a rectangular base and a single elastic cord wherein the elastic cord may be retained in the cord-retaining hooks to vary the projecting length of the elastic cord available to a user.

It is a further object of the invention to provide an exercise device utilizing a rectangular base and a single elastic cord wherein the selected ones of the cord-retaining hooks control the points along the perimeter of the base from which the ends of the single elastic cord extend outward to the user.

It is a still further object of the invention to provide an exercise device utilizing a rectangular base and a single elastic cord wherein the single elastic cord may be stored in the base.

It is yet another object of the invention to provide an exercise device utilizing a rectangular base and a single elastic cord that is compact and readily stored and/or transported.

BRIEF DESCRIPTION OF THE DRAWINGS

Various objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENT

The present invention provides a step-type exercise apparatus having a series of hooks disposed around its perimeter.

The hooks are disposed at two elevations relative to the bottom of the exercise device. A single elastic member secured to the exercise device may be configured in cooperation with one or more of the hooks to readily configure the novel exercise apparatus for use in a variety of different exercises.

Figure 1:
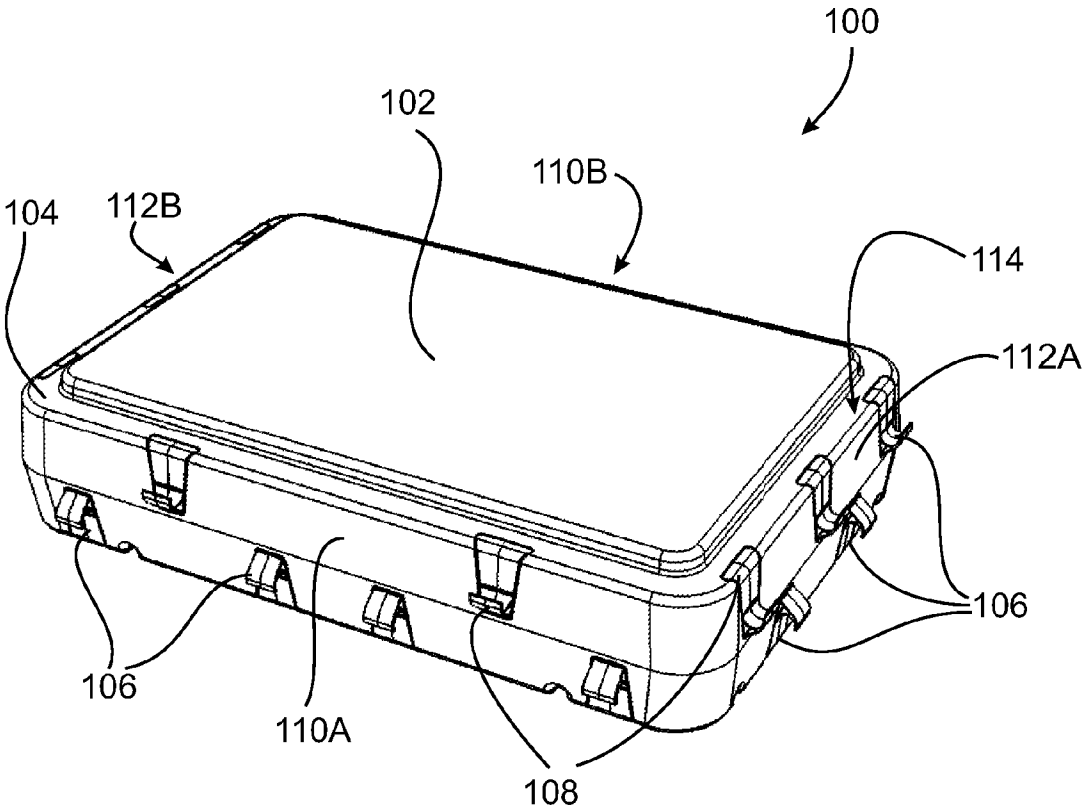
FIG. 1 is a front perspective, schematic view of the exercise apparatus for use with a single elastic member in accordance with the invention.

Referring first to FIG. 1, there is shown a front perspective, schematic view of the exercise apparatus for use with a single elastic member in accordance with the invention, generally at reference number 100. Exercise device 100 is substantially rectangular with a flat top surface 102. Flat top surface 102 is slightly smaller than upward facing surface 104 and is slightly elevated therefrom.

Exercise device 100 has a pair of upstanding end walls 112A, 112B and a pair of upstanding front and rear walls 110A, 110B, respectively substantially orthogonal to upstanding side walls 112A, 112B.

A series of top hooks 108 are disposed around the perimeter, not specifically identified, of exercise device 100 at approximately the height of upward facing surface 104. In addition, a series of lower hooks 106 are also disposed around the perimeter of exercise device 100, typically elevated slightly above a bottom edge of exercise device 100.

Figure 2:
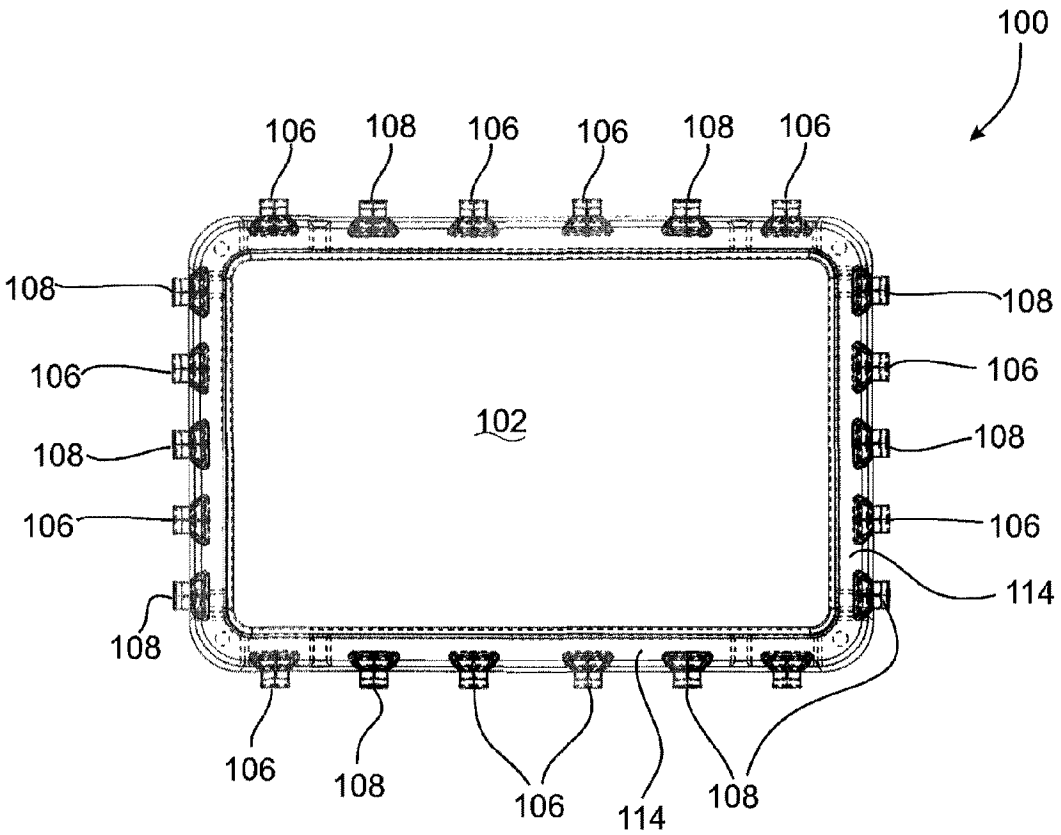
FIG. 2 is a top plan, schematic view of the exercise device of FIG. 1.

Referring now also to FIG. 2, there is show a top plan, schematic view of the exercise device of FIG. 1. An upward facing ledge 114 completely surrounds flat top surface 102 and. As may be seen in FIG. 1, upward facing ledge is at a slightly lower level relative to flat top surface 102. Upward facing ledge 114 helps provide strength to exercise device 100. In addition, upward facing ledge ensures that the tops of hooks 108 are kept free of a user's feet or other portion of a user's body resting on flat top surface 102.

Figure 3B:
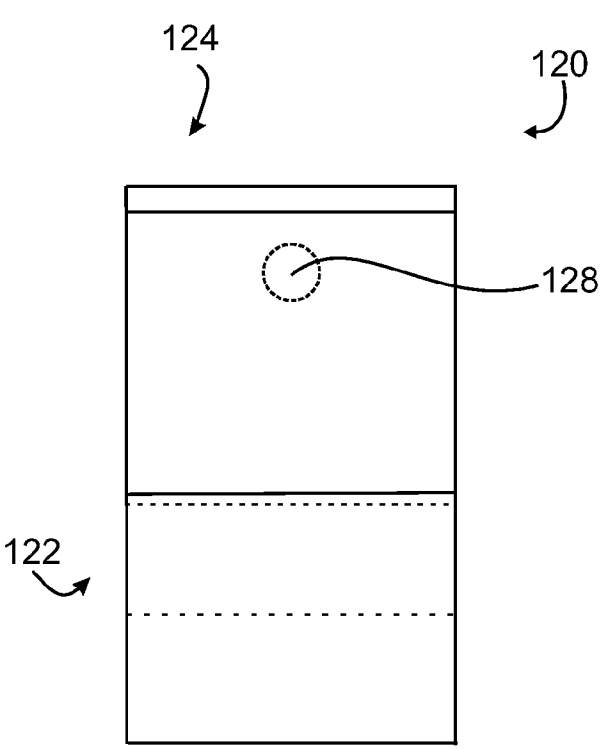
FIGS. 3A and 3B are side elevational and front elevational, schematic views, respectively of a hook for use with the exercise apparatus of FIGS. 1 and 2.
Figure 3A:
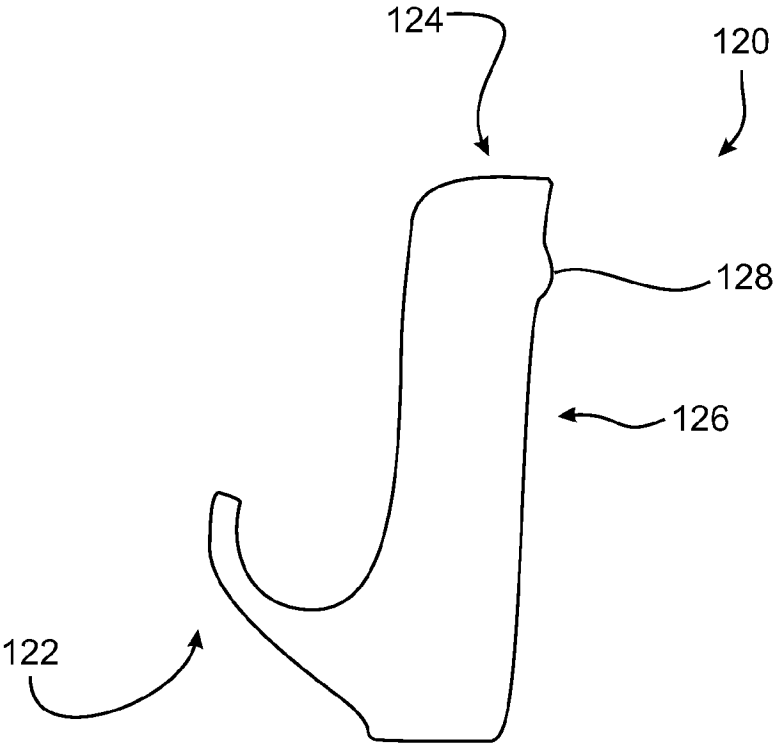

Referring now also to FIGS. 3A and 3B, there are shown side and front elevational, schematic views, respectively, of hook 120. Hook 120 has a proximal hook-shaped end 122 and an opposing distal end 124. Hook 120 is adapted for attachment to exercise device 100 in one of two different orientations. Top hooks 108 are hooks 120 mounted to exercise device 100 with distal end 122 on top proximate upward facing surface 104. Bottom hooks 108 are hooks 120 mounted to exercise device 100 with distal end 122 on the bottom adjacent a lower edge, not specifically identified, of exercise device 100. Hook 120 has a protruding locating projection 128 on a rear vertical thereof.

Figure 3C:
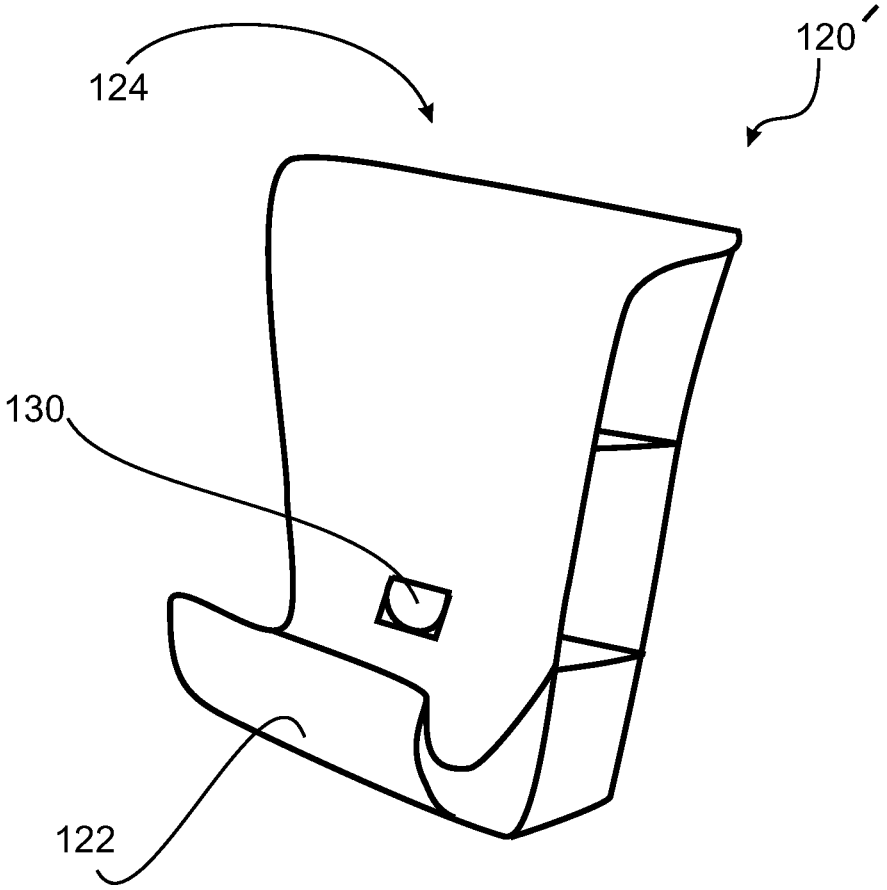
FIG. 3C is a perspective view of an alternate embodiment of the hook of FIGS. 3A and 3B and having a detent.

Referring now also to FIG. 3C is a perspective view of an alternate embodiment of hook 120, generally at reference number 120'. Hook 120' includes a detent 130. Detent 130 helps retain elastic member 140A, 140B, 140C (best seen in FIGS. 4A, 4B, and 4C, respectively) within the hook-shaped end 122.

Figures 4A, 4B, 4C:
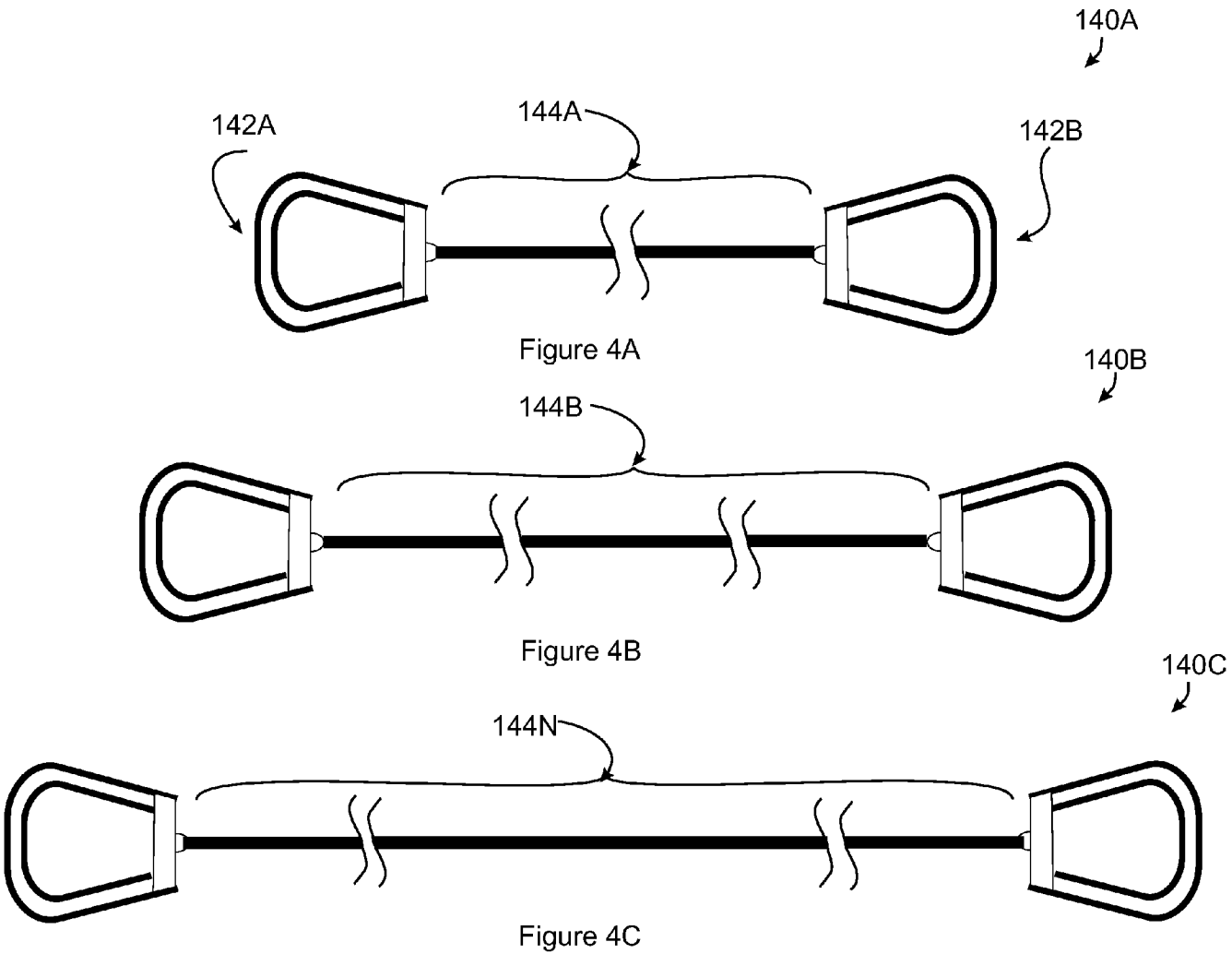
FIGS. 4A-4C are top plan, schematic views of three different length elastic members, respectively, for cooperative use with the exercise device of FIGS. 1 and 2.

Referring now to FIGS. 4A-4C, there are shown top plan, schematic views, respectively of three typical elastic members 140A, 140B, 140C for use with exercise device 100. Elastic elements 140A, 140B, 140C are identical with the exception of the length of elastic cords 144A, 144B, and 144N, respectively. Each elastic member 140A, 140B, 140C has a pair of handles 142A, 142B disposed at respective proximal and distal ends thereof.

Handles 142A, 142B are shown schematically and it will be understood that a wide variety of handle styles are known to those of skill in the art. Consequently, the invention is not considered limited to particular handles 142A, 142B shown for purposes of disclosure. Rather, the invention is intended to cover any and all suitable handles for an elastic member or other such cord.

Figure 4D:
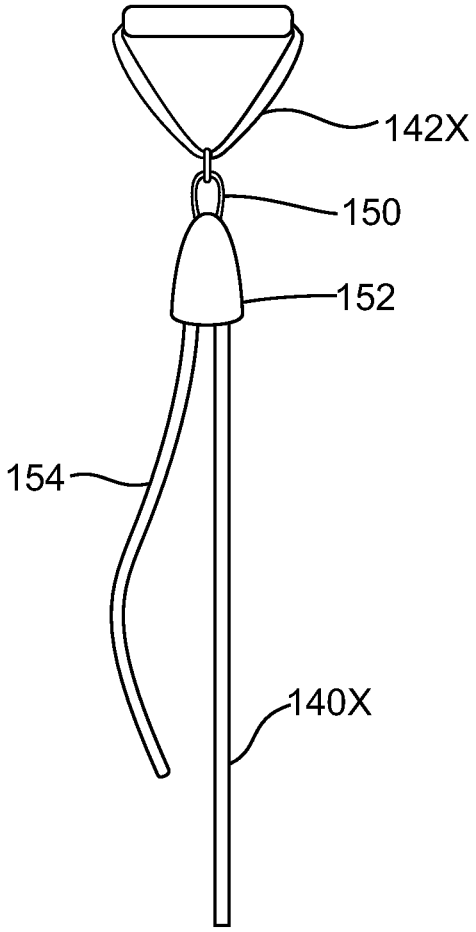
FIG. 4D is a top plan, schematic view of a portion of an elastic member of FIGS. 4A-4C showing a length adjusting device.

It will be recognized that elastic member 140A, 140B . . . 140N could have a length adjusting mechanism associated therewith. Referring now also to FIG. 4D, there is shown a top plan, schematic view of a portion of elastic member 140X having a length adjusting mechanism 152 attached to elastic member 140X adjacent a handle 142X by a connecting link 150. A portion 154 of elastic member 140X is shown extending beyond length adjusting mechanism 152. Length adjusting mechanisms 152 are believed to be well known to those of skill in the art and, consequently, are not further described or discussed herein.

In operation, a user selects an appropriate length elastic member 104A, 140B . . . 140N for the desired exercise and threads that elastic member (designated 140X) onto exercise device 100 along a desired path. If an elastic member 140A, 140B . . . 140N is equipped with a length adjusting mechanism, the effective length of elastics member 140A, 140B . . . 140N may be adjusted to a required length for a particular exercise.

The previously discussed arrangement of top hooks 108 and bottom hooks 106 form a serpentine path along which an elastic member 140A, 140B . . . 140N may be routed. A particular single elastic member 140A, 140B . . . 140N is selected by a user with which to perform a particular exercise regime.

Figure 5:
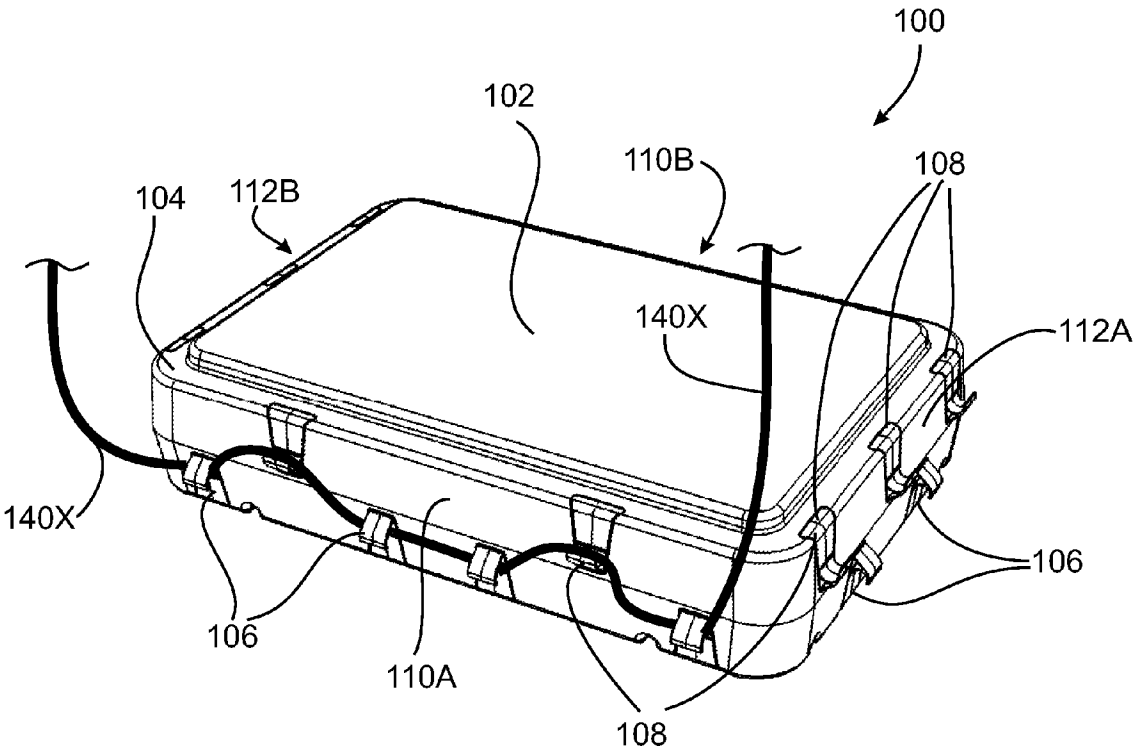
FIG. 5 is a perspective, schematic view of the exercise device of FIGS. 1 and 2 with an elastic member in place thereon.

Referring now also to FIG. 5, there is shown a perspective, schematic view of exercise device 100 with a generic elastic member 140X threaded through upper hooks 108 and bottom hooks 106 in a typical manner. As used herein, the term 140X refers to any elastic member 140A, 140B, and 140N and is intended to indicate that any elastic member may be used as shown.

Figure 6:
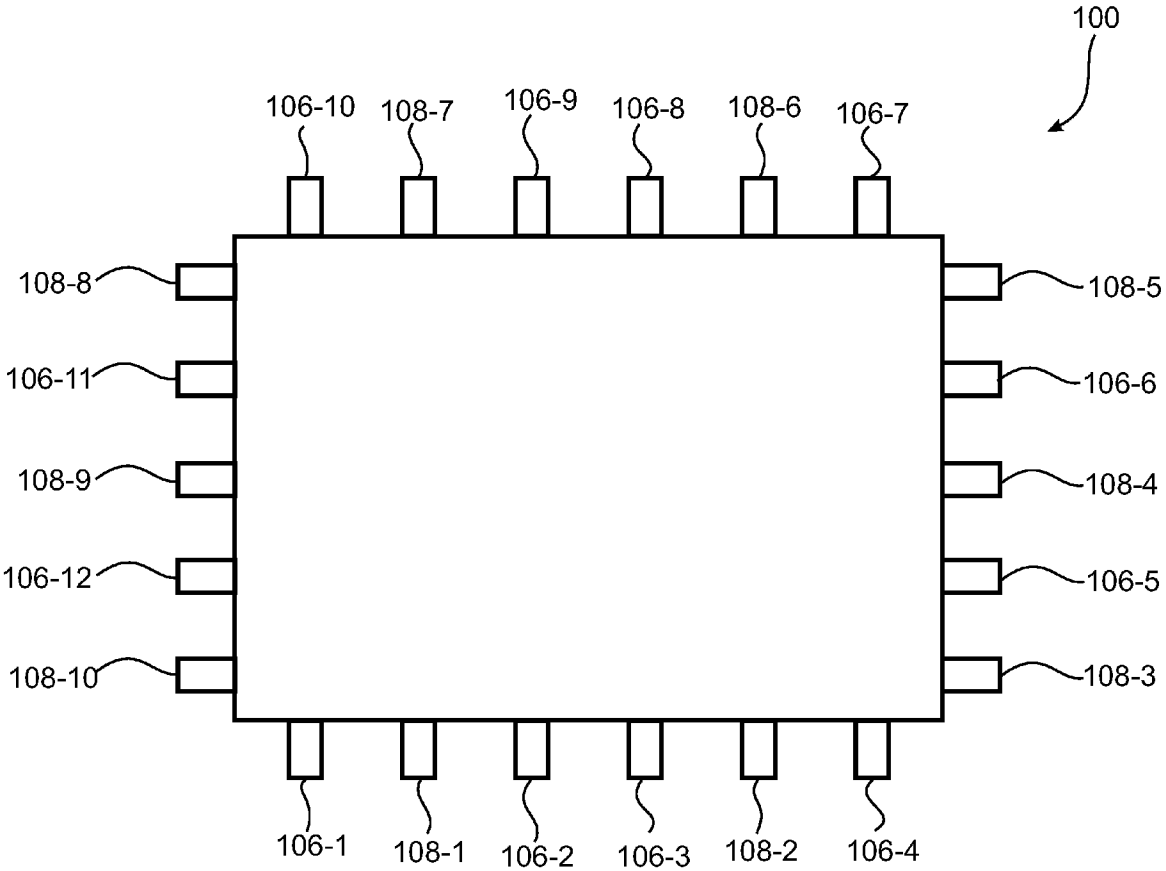
FIG. 6 is a top plan view of the exercise device of FIGS. 1 and 2 with each hook uniquely identified.

Referring now also to FIG. 6, there is shown a top plan, schematic view of exercise device 100 showing the arrangement of top hooks 108 and bottom hooks 106 around the perimeter thereof. Each top hook 108 and bottom hook 106 is identified with a unique reference number, for example 108-*n* and 106-*n* where n signifies unique position identification. Hook numbering begins at the left front corner of exercise device 100 with 106-1 and progresses counterclockwise around the perimeter of exercise device, ending with hook number 108-10. These hook numbers are used hereinbelow to describe the points of egress and routing of elastic member 140X. Therefore, FIG. 6 serves as a reference to describe various paths and points of egress of elastic member 140X in cooperation with FIGS. 7A-7H hereinbelow.

Referring now also to FIGS. 7A-7G, exercise device 100 is shown in use by a human performing various exercises therewith. Various positions of the human user relative to exercise device 100 are illustrated to show the versatility of exercise device 100. The illustrated positions are each intended to show a single example of the use of exercise device 100 to strengthen a particular body region. It will be recognized that a large number of alternate positions may alternately be used to strengthen particular body regions. It will be further recognized that exercise device 100 may be used to strengthen other body regions.

Figure 7B:
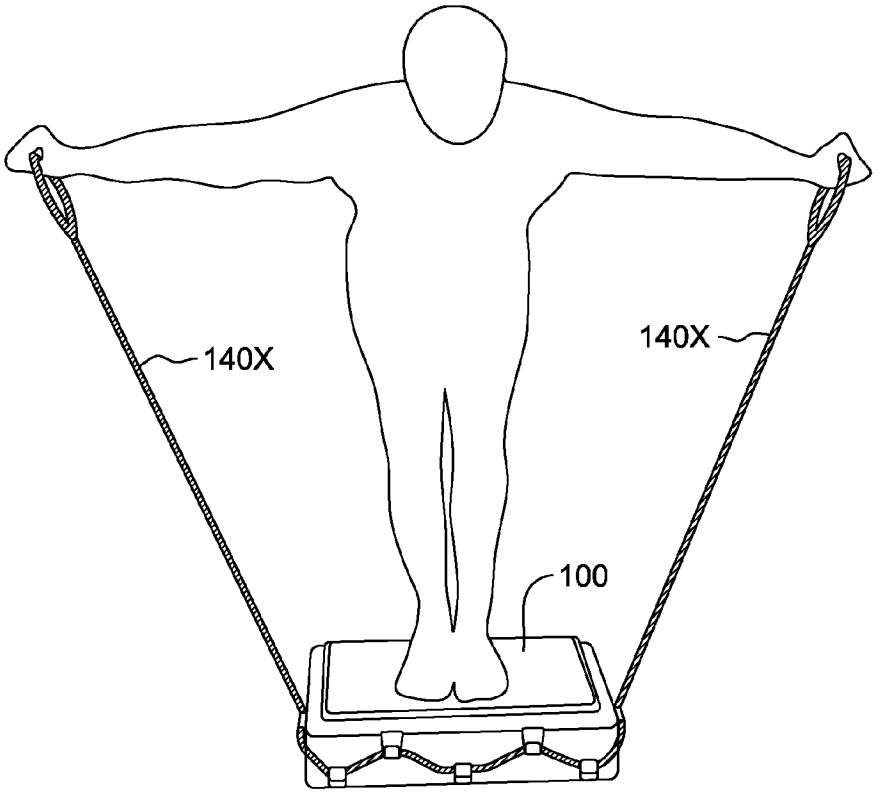
FIGS. 7A-7H are pictorial, schematic views of a user using the exercise device of FIGS. 1 and 2 to perform various exercises.
Figure 7A:
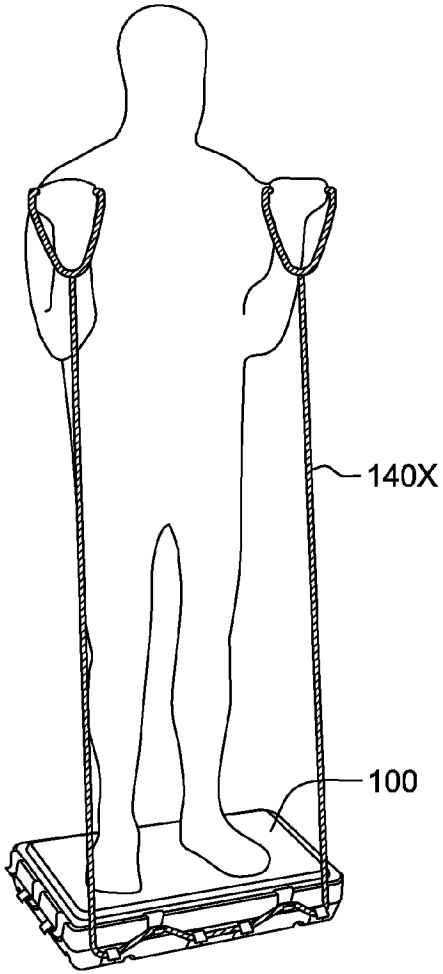

In FIG. 7A, a relatively long elastic member 140X is chosen and the illustrated exercise is intended primarily to strengthen the biceps of the user. Elastic member 140X is placed on exercise device 100 with ends extending upward from hooks 106-1 and 106-4 after being routed through hooks 108-1, 106-2, 106-3, and 108-2. It will be recognized that an appropriate length elastic member 140X is selected from elastic members 140A, 140B . . . 140N.

In FIG. 7B, exercise device 100 is shown configured for a back strengthening exercise. Elastic member 140X is placed on exercise device 100 with ends extending upward from hooks 108-10 and 108-3 after being routed through hooks 106-1,108-1, 106-2, 106-3, 108-2, and 106-4.

Figure 7D:
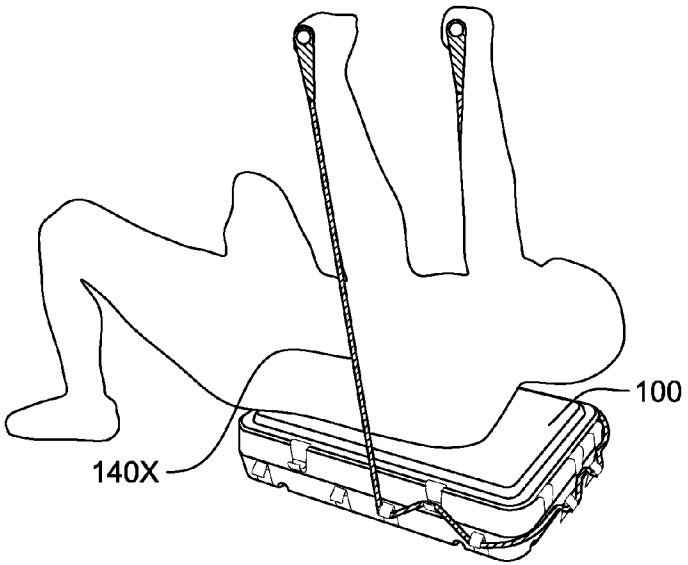
Figure 7C:
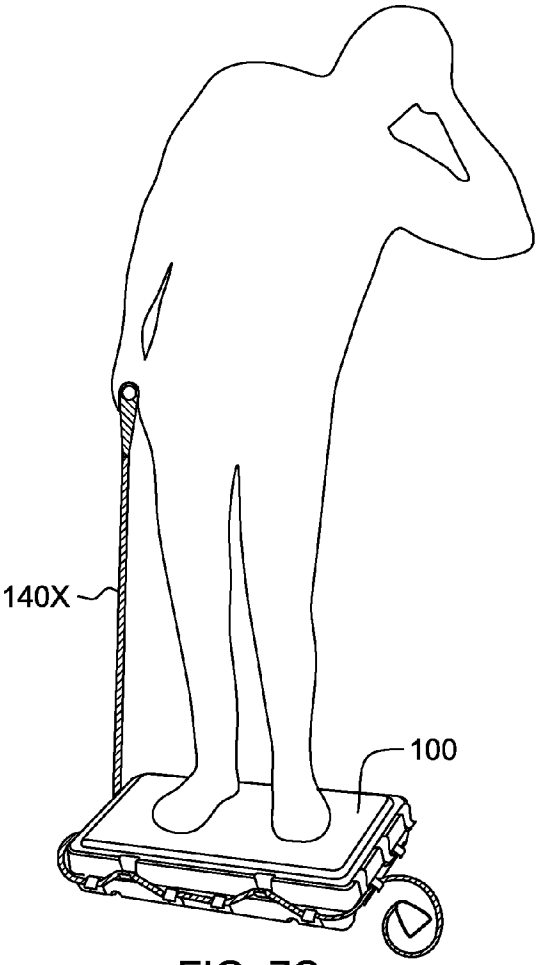

In FIG. 7C, exercise device 100 is shown configured for an exercise designed to strengthen the oblique (i.e., side abdominal) muscles. Elastic member 140X is placed on exercise device 100 with one of handles 142A, 142B abutted to hook 108-4. An opposing end of elastic member 140X extends upward from hook 108-9 after being routed through hooks 106-5, 108-3, 106-4, 108-2, 106-3, 106-2, 108-1, 106-1, 108-10 and 106-12.

In FIG. 7D, exercise device is shown configured for an exercise designed to strengthen the chest muscles. Elastic member 140X is placed on exercise device 100 with ends extending upward from hooks 106-3 and 106-8 after being routed through hooks 108-2 106-4, 108-3, 106-5, 108-4, 106-6, 108-5, 106-7, and 108-6.

Figure 7F:
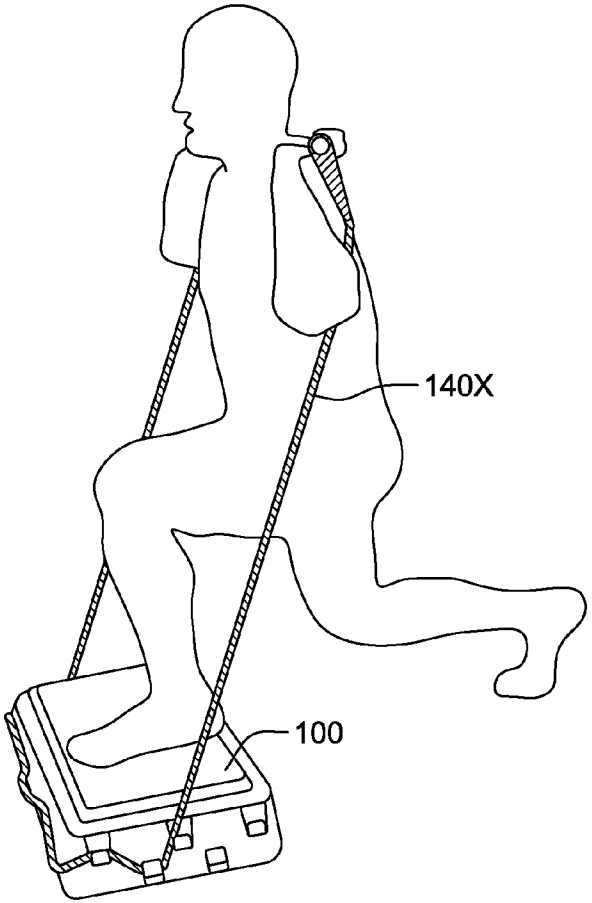
Figure 7E:
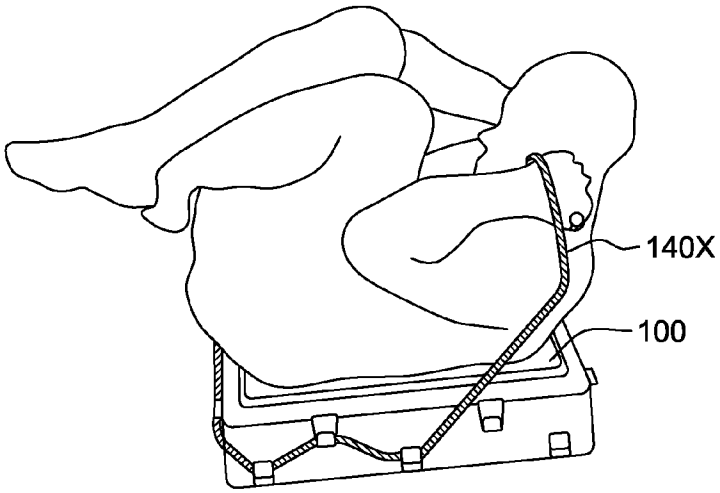

In FIG. 7E, exercise device is shown configured for an exercise designed to strengthen the abdominal muscles (i.e., "abs"). Elastic member 140X is placed on exercise device 100 with ends extending upward from hooks 106-2 and 106-9 after being routed through hooks 108-1, 106-1, 108-10, 106-12, 108-9, 106-11, 108-8, 106-10 and 108-7.

In FIG. 7F, exercise device is shown configured for an exercise designed to strengthen the leg muscles. Elastic member 140X is placed on exercise device 100 with ends extending upward from hooks 106-5 and 106-12 after being routed through hooks 108-3, 106-4, 108-2, 106-3, 106-2, 108-1, and 106-1.

Figure 7H:
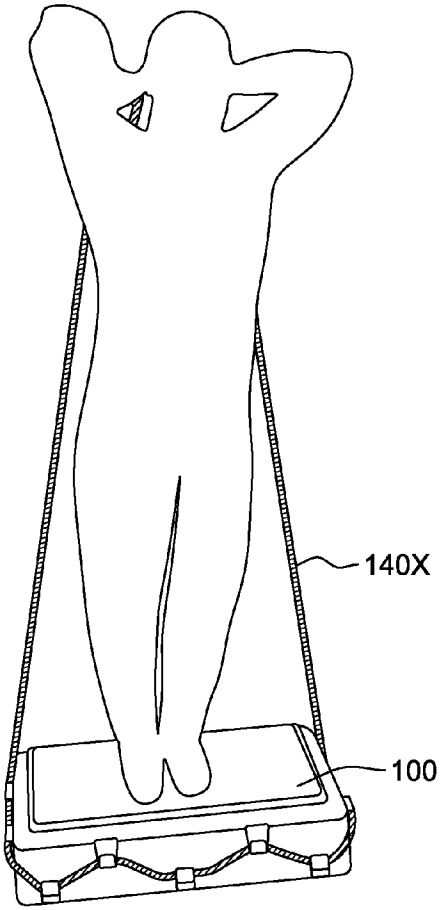
Figure 7G:
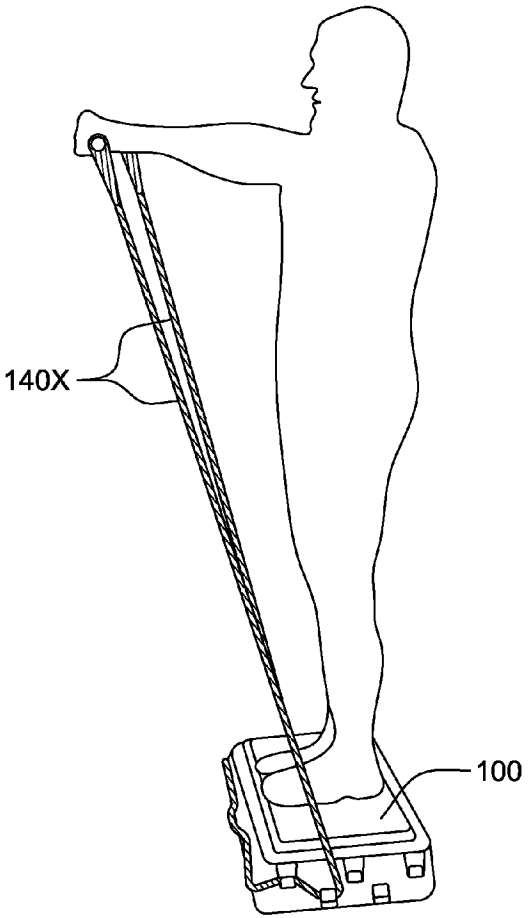

In FIG. 7G, exercise device is shown configured for an exercise designed to strengthen the shoulder muscles. Elastic member 140X is placed on exercise device 100 with ends extending upward from hooks 106-5 and 106-12 after being routed through hooks 108-3, 106-4, 108-2, 106-3, 106-2, 108-1, 106-1, and 108-10. This is the same routing of elastic member 140X as shown in FIG. 7F. However, a longer elastic member 140X that that shown in FIG. 7F may be required.

In FIG. 7H, exercise device is shown configured for an exercise designed to strengthen the triceps muscles. Elastic member 140X is placed on exercise device 100 with ends extending upward from hooks 106-5 and 106-12 after being routed through hooks 108-3, 106-4, 108-2, 106-3, 106-2, 108-1, 106-1, and 108-10.

These configurations are examples of numerous configurations that may readily be implement using exercise device 100 in cooperation with an elastic member 140X selected from elastic members 140A, 140B . . . 140N. Consequently, the invention is not considered limited to these configurations chosen for purposes of disclosure. Rather, the invention is intended to include any and all configurations obtainable with one or more elastic members 140X using hooks selected from hooks 106-1 . . . 106-12 and hooks 108-1 . . . 108-10.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. An exercise device, comprising:

a) a rectangular step having a width, a length, a height, a flat upper surface, a pair of opposing upstanding end walls, a pair of opposing upstanding side walls disposed orthogonally to said pair of upstanding end walls, and a perimeter; said step adapted for user support;

b) a plurality of hooks having an upward-facing hook opening disposed around said perimeter of said rectangular step proximate said upper surface; and c) a plurality of hooks having a downward-facing hook opening disposed around said perimeter adjacent a lower edge of said pair of opposing end walls, and said pair of opposing side walls, said hooks having an upward-facing hook opening being interspersed with said hooks having a downward-facing hook opening along said perimeter; wherein an elastic member having an exercise handle may be removably threaded through said hooks.

2. The exercise device recited in claim 1, wherein said hooks having an upward-facing hook opening and said hooks having a downward-facing hook opening have a width across respective ones of said upward-facing hook openings and said downward-facing hook openings.

3. The exercise device recited in claim 2, wherein said hooks having an upward-facing hook opening have at least one hook having a downward-facing hook opening interspersed therebetween along said perimeter.

4. The exercise device recited in claim 2, wherein at least one pair of said hooks having an upward-facing hook opening have two hooks having a downward-facing hook opening interspersed therebetween.

5. The exercise device recited in claim 2 wherein hooks adjacent each end of said pair of upstanding end walls comprise hooks having downward-facing hook openings.

6. The exercise device recited in claim 2 wherein hooks adjacent each end of said pair of upstanding side walls comprise hooks having upward-facing hook openings.

7. An exercise device, comprising:

a) a rectangular step having a width, a length, a height, a flat upper surface, a pair of opposing upstanding end walls, a pair of opposing upstanding side walls disposed orthogonally to said pair of upstanding end walls, and a perimeter; said step adapted for user support;

b) a ledge having an upward facing surface parallel said upward facing top surface circumferentially disposed therearound intermediate said upward facing top surface and an upper edge of said each of said pair of upstanding side walls and said upstanding end walls, said upward facing surface of said ledge being at a level lower than said upward facing top surface;

c) a plurality of hooks having an upward-facing hook opening disposed around said perimeter of said rectangular step proximate said upward facing surface of said ledge; and d) a plurality of hooks having a downward-facing hook openings disposed around said perimeter adjacent a lower edge of said pair of opposing end walls, and said pair of opposing side walls, said hooks having an upward-facing hook opening being interspersed with said hooks having a downward-facing hook opening along said perimeter; wherein an elastic member having an exercise handle may be removably threaded through said hooks.

8. The exercise device recited in claim 7, wherein said hooks having an upward-facing hook opening and said hooks having a downward-facing hook opening have a width across respective ones of said upward-facing hook openings and said downward-facing hook openings.

9. The exercise device recited in claim 8, wherein said hooks having an upward-facing hook opening have at least one hook having a downward-facing hook opening interspersed therebetween along said perimeter.

10. The exercise device recited in claim 8, wherein at least one pair of said hooks having an upward-facing hook opening have two hooks having a downward-facing hook opening interspersed therebetween along said perimeter.

11. The exercise device recited in claim 10 wherein hooks adjacent each end of said pair of upstanding end walls comprise hooks having downward-facing hook openings.

12. The exercise device recited in claim 8 wherein hooks adjacent each end of said pair of upstanding side walls comprise hooks having upward-facing hook openings.

* * * * *